US006672590B1

(12) United States Patent
Olsen et al.

(10) Patent No.: US 6,672,590 B1
(45) Date of Patent: Jan. 6, 2004

(54) BOARD GAME FOR PROMOTING HOMETOWN IDENTITY

(76) Inventors: Jeffrey S. Olsen, 27504 365th Ave., Platte, SD (US) 57369; Jacqueline R. Olsen, 27504 365th Ave., Platte, SD (US) 57369; Jentre J. Olsen, 27504 365th Ave., Platte, SD (US) 57369

( * ) Notice: Subject to any disclaimer, the term of this patent is extended or adjusted under 35 U.S.C. 154(b) by 0 days.

(21) Appl. No.: 10/272,895

(22) Filed: Oct. 17, 2002

(51) Int. Cl.[7] ..... A63F 3/00

(52) U.S. Cl. ..... 273/254; 273/248; 273/302; 273/431

(58) Field of Search ..... 273/243, 248, 273/254, 431, 302, 236, 244, 292, 296, 300

(56) References Cited

U.S. PATENT DOCUMENTS 3,826,499 A * 7/1974 Lenkoff ..... 273/240
5,120,065 A * 6/1992 Driscoll et al. ..... 273/237
5,788,238 A * 8/1998 LeBriton et al. ..... 273/272

* cited by examiner

*Primary Examiner*—V K Mendiratta

(57) ABSTRACT

A board game system for promoting hometown identity includes providing a game apparatus, rolling a die, and moving the player's game piece along the game path. The method also includes coloring, by a player, one of the stripe portions of the scoring sheet red or coloring the field portion of the scoring sheet blue, when a preset condition is satisfied. The game is won by the player having all of the stripe portions colored red and the field portion colored blue. The game apparatus may include a game board having a path for advancing game pieces of players along. Some spaces have sponsor indicia associated with a sponsoring entity located in a hometown local. The apparatus includes a scoring sheet having stripe portions and a field portion. The stripe portions and field portion are arranged on the scoring sheet in a configuration appearing as a United States flag.

19 Claims, 6 Drawing Sheets

BOARD GAME FOR PROMOTING HOMETOWN IDENTITY

BACKGROUND OF THE INVENTION

1. Field of the Invention

The present invention relates to board games and more particularly pertains to a new board game system for promoting hometown identity among inhabitants of the hometown when they play the game.

2. Description of the Prior Art

A multitude of various board games are known in the prior art for providing entertainment to the players of the various board games. The known games tend to be set in fictional areas that are unrecognizable to the players in the real world, or are set in well known areas that few players have actually visited, such as Depression-era Atlantic City in the game known as MONOPOLY. However, insofar as is known, none of the prior art games are specifically directed to, tailored to, and capable of, familiarizing players of the game with a particular hometown or home area or locale of the players, especially in a manner that encourages the players to further familiarize themselves with the institutions and people of their home town or locale.

The board game system for promoting hometown identity according to the present invention is thus believed to substantially depart from the conventional concepts and designs of the games known and recognized in the gaming prior art.

SUMMARY OF THE INVENTION

The present invention provides a new board game, and method of playing the game, which has a primary purpose of promoting hometown identity among inhabitants of the hometown when they play the game.

To attain this, the invention has both method and apparatus aspects. The method aspects of the invention includes providing a game apparatus that includes a game board having a path for advancing game pieces of players along and a scoring sheet having a plurality of stripe portions and a field portion. The stripe portions and field portion are arranged on the scoring sheet in a configuration appearing as a United States flag. The method includes rolling a die by a player and moving the player's game piece along the game path a number of spaces corresponding to a value indicated by the die and landing the player's game piece on one of the plurality of spaces. The method further includes coloring, by a player, one of the stripe portions of the scoring sheet of the player with the red marking device or coloring the field portion of the scoring sheet of the player with the blue marking device, when a preset condition is satisfied. The game is won by the first player to have all of the stripe portions of the scoring sheet colored red and the field portion colored blue.

The apparatus aspect of the invention includes a game board having a path for advancing game pieces of players along, and the path comprising a plurality of spaces for advancing the game piece of a player as the player moves along the game path. A portion of the spaces each has a sponsor indicium marked thereon that is associated with a sponsoring entity located in a geographical area. The apparatus also includes a scoring sheet having a plurality of stripe portions and a field portion arranged on the scoring sheet in a configuration appearing as a United States flag. The stripe portions may be separated from each other by at least one blank stripe portion. The apparatus may also include a plurality of dice, a plurality of game pieces, and a plurality of marking devices for marking on the game sheets. The plurality of marking devices may include a red marking device and a blue marking device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One particular distinct advantage of the game system of the invention is that familiarity with the organizations, institutions, and businesses of the players' hometown is rewarded during play of the game, as those players demonstrating the greatest ability to identify people associated with these entities find it easier to complete their respective scoring sheets and ultimately win the game. Those players that are not as familiar with local entities must rely primarily upon their ability to correctly answer trivia questions in various categories to complete their scoring sheets.

Other advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
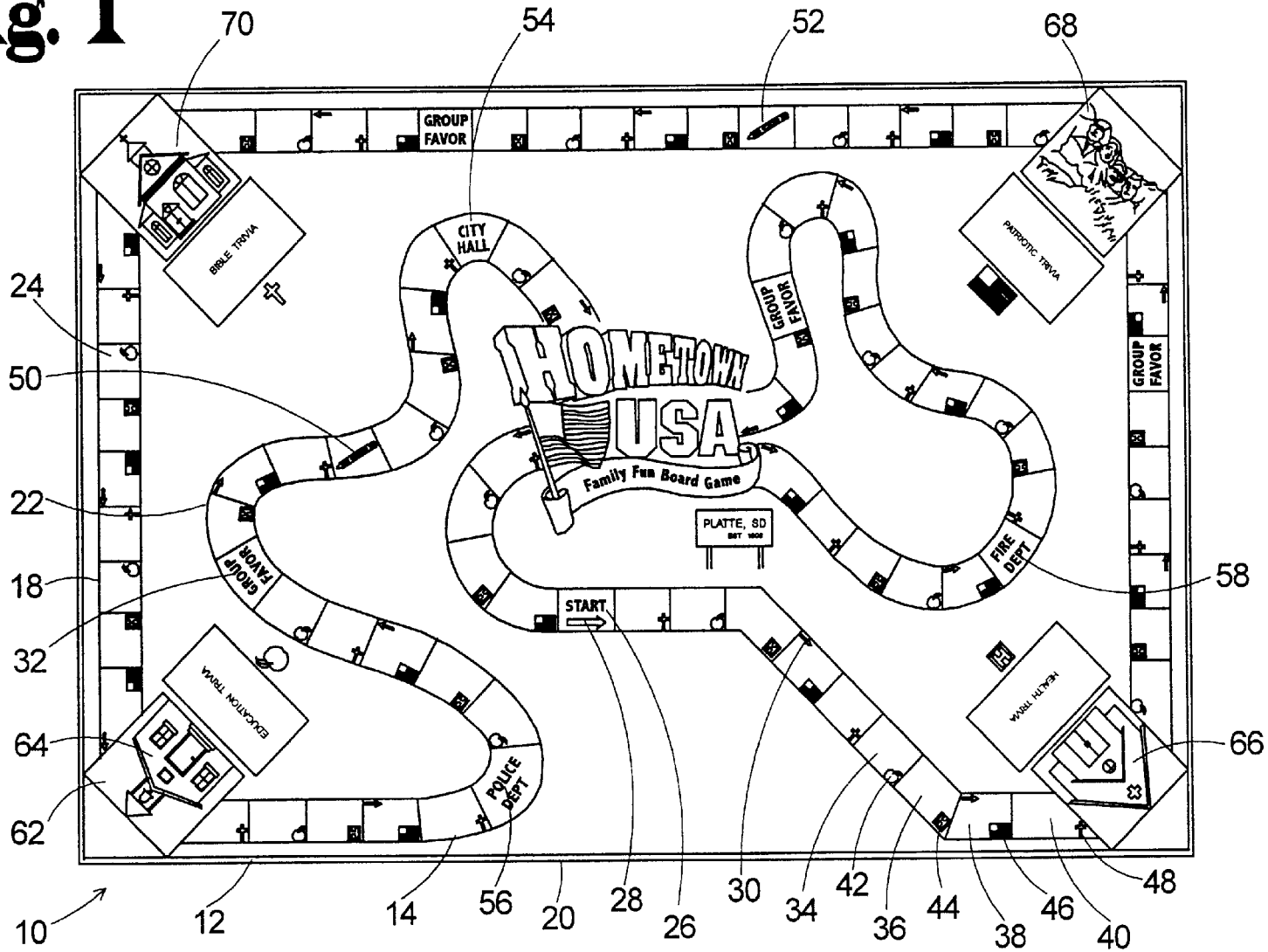
FIG. 1 is a schematic plan view of one embodiment of the game board of the new game system for promoting hometown identity according to the present invention.
Figure 2:
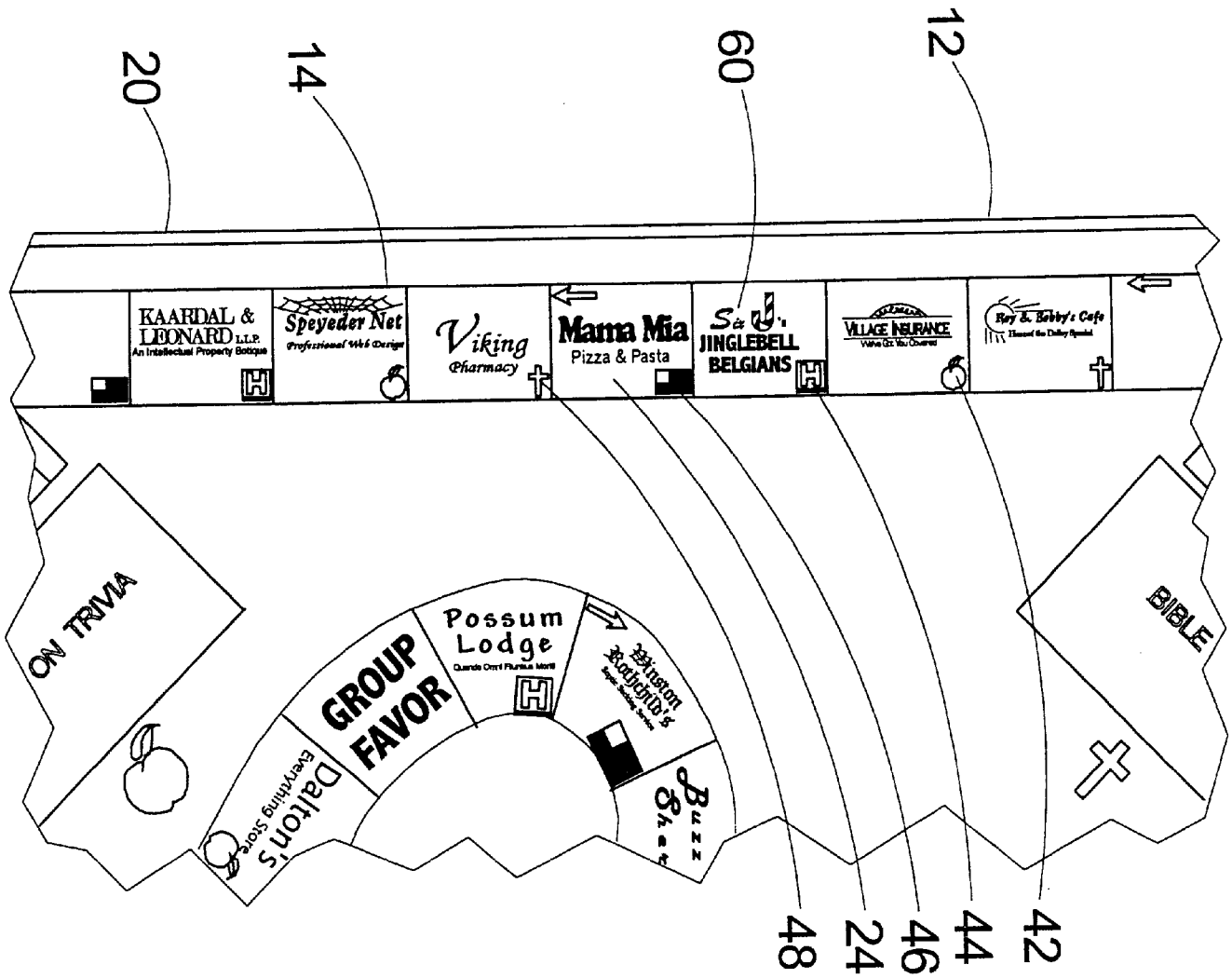
FIG. 2 is a schematic plan view of a portion of the game board of the present invention having sponsor indicia marked on spaces of the path.
Figure 3:
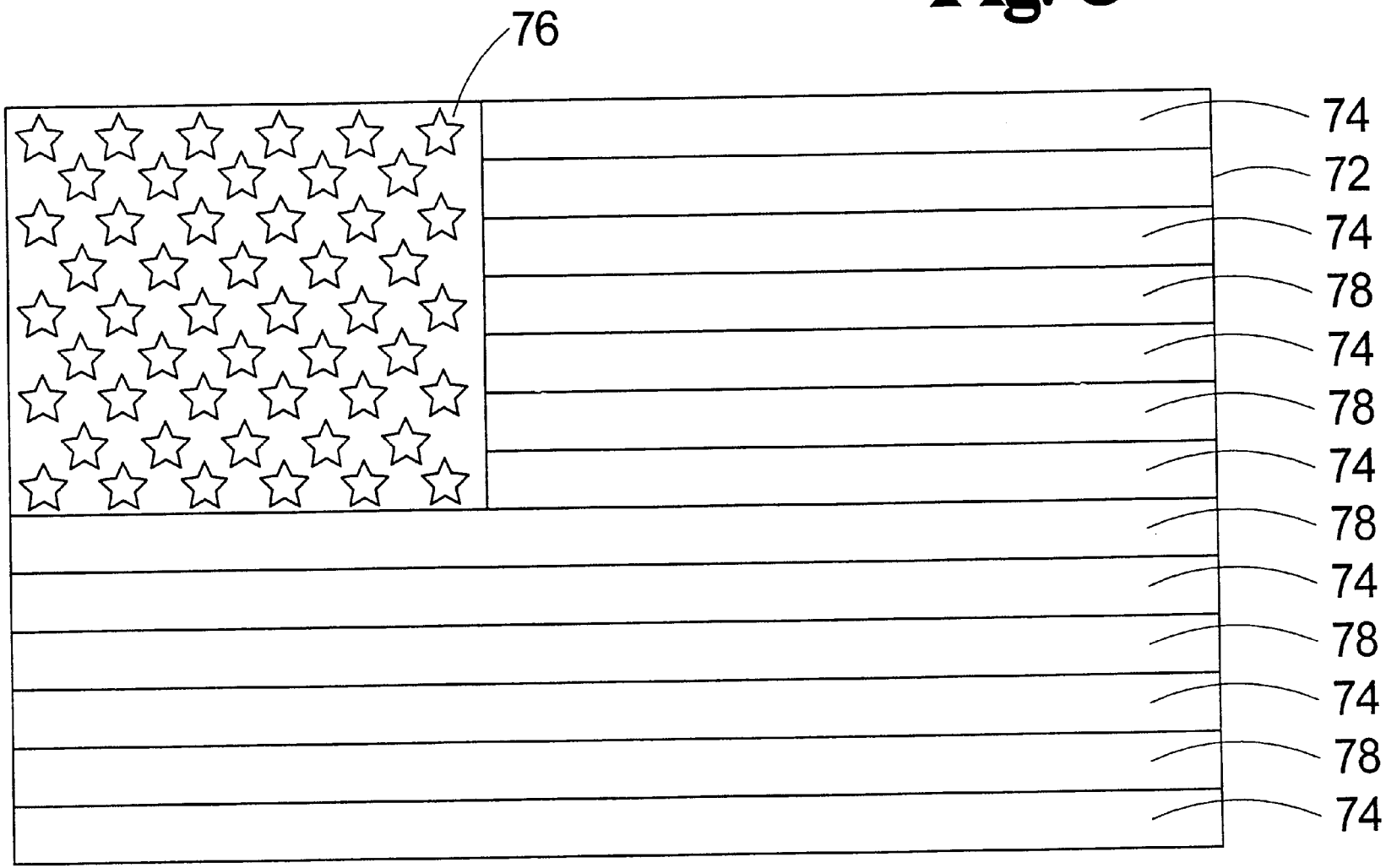
FIG. 3 is a schematic plan view of a score sheet of the game system of the present invention.
Figure 4:
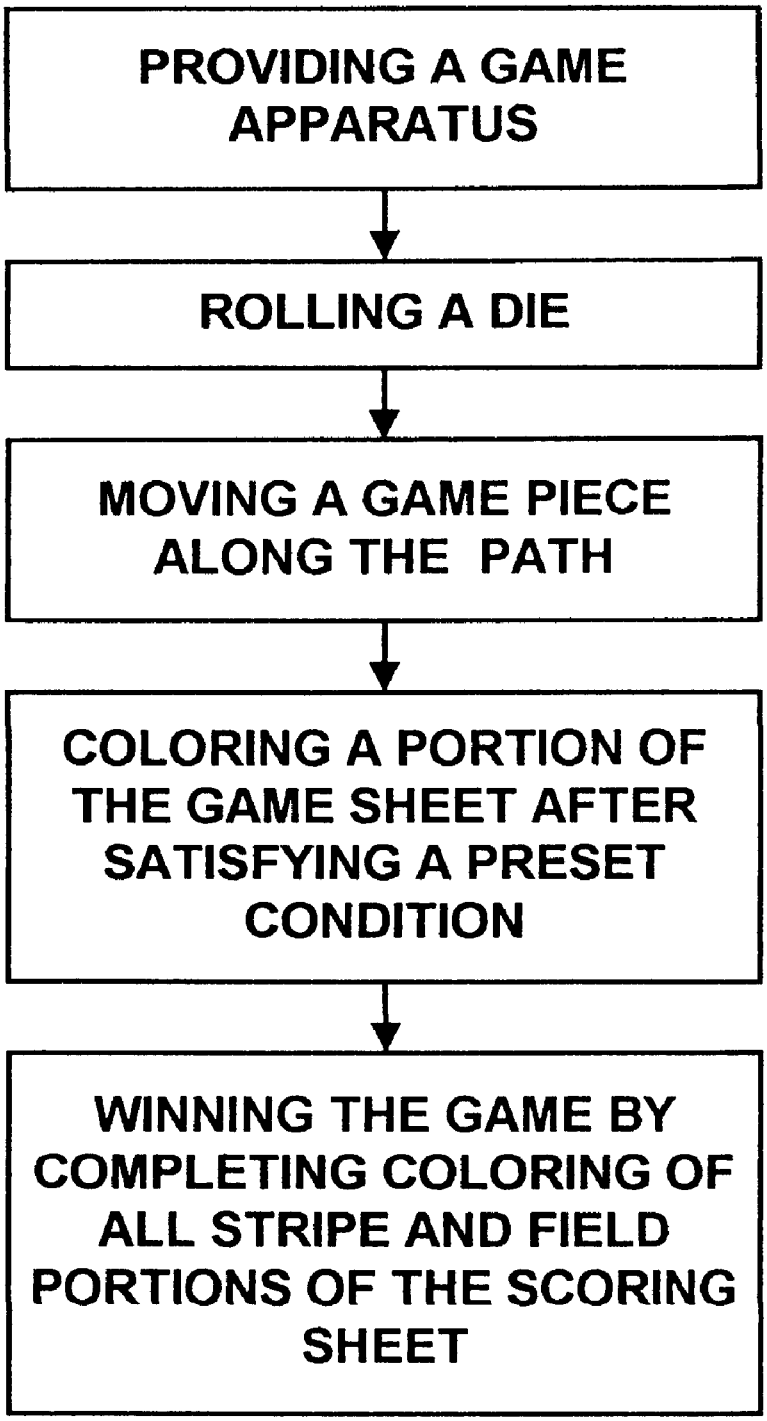
FIG. 4 is a schematic flow diagram of the method aspects of the present invention.
Figure 5:
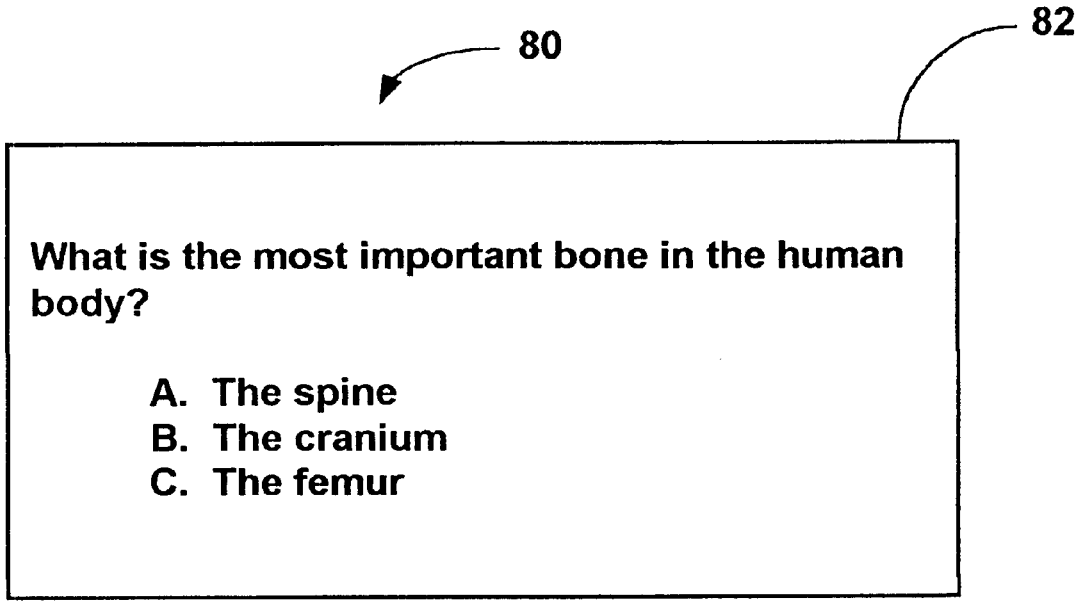
FIG. 5 is a schematic front view of a multiple choice trivia card of the present invention.
Figure 6:
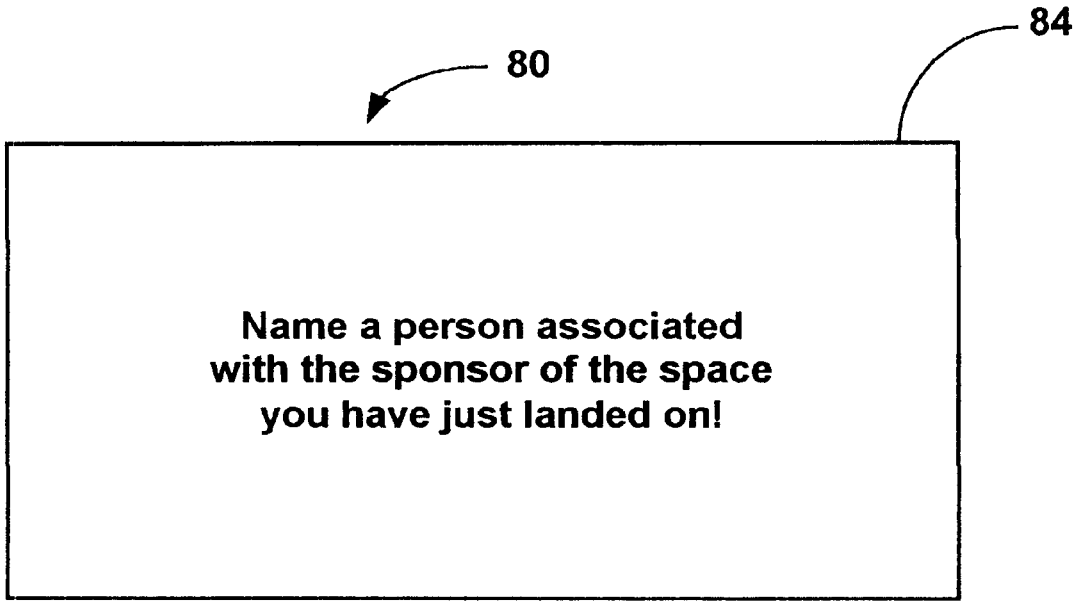
FIG. 6 is a schematic front view of a sponsor association card of the present invention.
Figure 7:
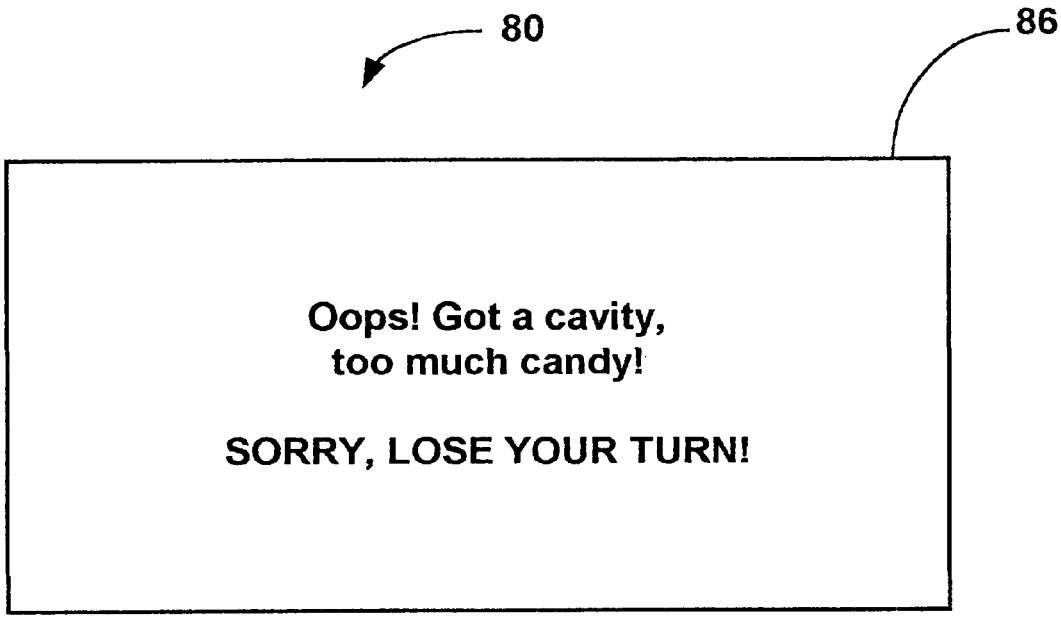
FIG. 7 is a schematic front view of a "lose a turn" card of the present invention.
Figure 8:
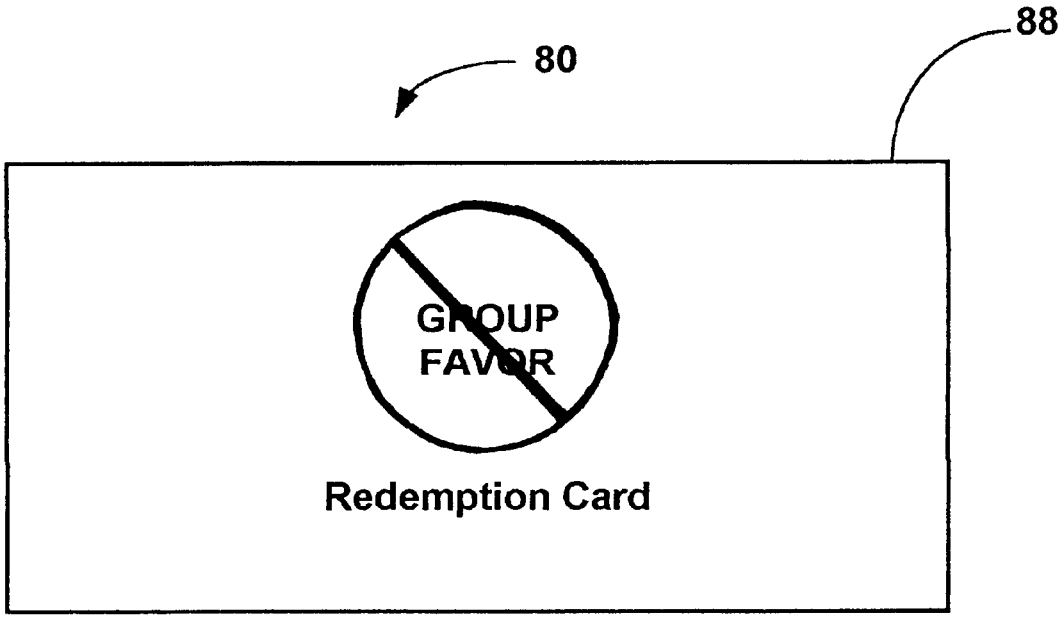
FIG. 8 is a schematic front view of a group favor redemption card of the present invention.

With reference now to the drawings, and in particular to FIGS. 1 through 8 thereof, a new board game for promoting hometown identity embodying the principles and concepts of the present invention and generally designated by the reference numeral 10 will be described.

As best illustrated in FIGS. 1 through 8, one aspect of the invention comprises a game apparatus 10 for promoting hometown identity 10 and another aspect of the invention comprises a method of playing the game apparatus in a manner promoting hometown identity.

The game apparatus 10 may include a game board 12, and on the top surface of the game board is marked a path 14 along which a game piece of each of the players is moved. The path 14 may have a perimeter portion 18 that is positioned along a portion of a perimeter 20 of the game board 12 and a convoluted portion 22 of the path that is positioned substantially within the perimeter portion 18 of the path 14. The path 14 may comprise a plurality of spaces 24 for advancing the game piece of a player as the player moves along the game path.

In one embodiment of the invention, a substantial portion of the plurality of spaces 24 have indicia marked thereon, and the significance of the indicia to the method of play of the game will be discussed in greater detail below in the context of the discussion of the manner of playing the game. In greater detail, one of the plurality of spaces 24 comprises a start space 26, which may have "START" indicium marked thereon. The start space 26 may have a directional arrow indicium 28 marked thereon. One or more of the plurality of spaces 24 may have a directional arrow 30 marked thereon for indicating to the players a direction of movement of the game pieces by the players as they are advancing their game pieces along the path 14. Further, a portion of the plurality of spaces of the path may comprise "GROUP FAVOR" spaces 32, and which may have "GROUP FAVOR" marked thereon to indicate those spaces.

A first portion 34 of the plurality of spaces of the path may be associated with a first trivia category, a second portion 36 of the plurality of spaces may be associated with a second trivia category, a third portion 38 of the spaces may be associated with a third trivia category, and a fourth portion 40 of the spaces may be associated with a fourth trivia category.

A theme may be associated with each of the trivia categories, and in one embodiment of the invention, the first trivia category has an education theme, the second trivia category has a health theme, the third trivia category has a patriotic theme, and the fourth trivia category has a religious theme. Common indicia may be marked on each of the spaces of each of the portions of the spaces, and the indicia may correspond to the theme of the trivia category. In one embodiment of the invention, the spaces of the first portion 34 have a first indicium 42 comprising an apple marked thereon, the spaces of the second portion 36 have a second indicium 44 comprising an "H" marked thereon, the spaces of the third portion 38 have a third indicium 46 comprising a flag marked thereon, and the spaces of the fourth portion 38 have a fourth indicium 48 comprising a cross marked thereon.

A red crayon indicium 50 may be marked on one of the plurality of spaces, and a blue crayon indicium 52 may be marked on one of the plurality of spaces for purposes that will be described in greater detail below. The plurality of spaces may also include a group of city services spaces. One of the group of city services spaces may have "CITY HALL" indicium 54 marked thereon, another one of the group of city services spaces may have "POLICE DEPT." indicium 56 marked thereon, and yet another one of the group of city services spaces may have "FIRE DEPT." indicium 58 marked thereon.

Significantly, a large portion of the plurality of spaces 24 along the path 14 may each have sponsor indicia 60 marked thereon. Each sponsor indicium may be associated with a sponsoring entity that is preferably located in a geographical area corresponding to the hometown or home locale upon which the particular game is based, and that will preferably be familiar to players from the hometown or home locale.

Additionally, a plurality of areas 62 may be positioned along the game path 14 and in between adjacent spaces 24 of the path. In one embodiment of the invention, each of the areas 62 does not count as one of the spaces along the game path 14 when a player advances his or her game piece along the game path. One of the areas 62 may comprise a school area with a school indicium 64 marked thereon, one of the areas 62 may comprise a hospital area with a hospital indicium 66 marked thereon, one of the areas 62 may comprise a patriotic area with Mount Rushmore indicium 68 marked thereon, and one of the areas 62 may comprise a church area with a church indicium 70 marked thereon.

In addition to the game board 12, the game apparatus 10 may also include a scoring sheet 72 for each player that participates in playing the game. Each of the scoring sheets 72 may have a plurality of stripe portions 74 and a field portion 76. Preferably, the stripe portions 74 and the field portion 76 are arranged on the scoring sheet 72 in a configuration resembling and appearing as a United States flag. The stripe portions 74 may be separated from each other by at least one blank stripe portion 78, so that the stripe portions 74 and the blank stripe portions 78 alternate with each other across the scoring sheet.

The game apparatus 10 may also include one or more die for indicating to players the number of spaces 24 to advance along the game path 14. The game apparatus 10 may also include a game piece for each player to indicate the player's position along the game path 14.

The game apparatus may also include a plurality of marking devices for marking on the scoring sheets 72. The plurality of marking devices may include two marking devices, including a red marking device and a blue marking device, the use of which will be described in greater detail in the context of the method.

The game apparatus 10 may also include a plurality of sets of cards 80. Each of the plurality of sets of cards 80 may include a first set of the plurality of cards that is associated with the first trivia category, a second set associated with the second trivia category, a third set associated with the third trivia category, and a fourth set associated with the fourth trivia category.

Each of the sets of cards may be further divided into a plurality of subsets of cards, including a first subset which comprises multiple choice trivia cards 82, a second subset which comprises sponsor association cards 84, a third subset which comprises "lose a turn" cards 86, and a fourth subset which comprises "group favor redemption" cards 88.

The method aspect of the invention for playing the game may be practiced using one or more elements of the game apparatus 10 described above. In the practice of the game, each player initiates his or her turn by rolling one or more dice to determine a number of spaces to advance along the game path 14. The player may move his or her game piece along the path a number of spaces corresponding to the value shown by the rolled die or dice. The player lands his or her game piece on one of the plurality of spaces 24.

The player may select one card from the particular set of cards of the trivia category corresponding to the indicium that is marked on the space on which the player's game piece has landed. If the player draws one of the "lose a turn" cards, the player loses his or her current turn and does not takes any further steps or actions until the next occurrence of the player's turn.

If the player draws a "GROUP FAVOR" card, the player should perform a group favor unless the player holds one of the group favor redemption cards. Performance of the group favor may include obtaining a snack for each of the other players that are playing the game, such as obtaining food or drink for the group.

During his or her turn, the player may be entitled to color or fill in one of the stripe portions of his or her scoring sheet of the player with the red marking device, or color or fill in the field portion of his or her scoring sheet of the player with the blue marking device, when the player meets or fulfils one of a number of preset conditions. One of the preset conditions may comprise landing the player's game piece on a space of the path, and then correctly answering the question from one of the sets of cards. Another one of the preset conditions may comprise landing on a space, drawing a sponsor association card 78 of the second subset and then correctly naming a person associated with the sponsoring entity associated with the sponsor indicium of the space on which the game piece has landed. Another one of the preset conditions may comprise landing on one of the city services spaces marked "CITY HALL" and naming the mayor of the hometown, landing on one of the city services spaces marked "POLICE DEPT" and naming one of the members of the police department of the hometown, or landing on one of the city services spaces marked "FIRE DEPT" and naming one of the members of the fire department of the hometown. Another one of the preset conditions may comprise landing on the space on the path that has the red crayon indicium marked thereon, so that the player may then coloring one of the stripe portions of the scoring sheet red, or landing on the space having the blue crayon indicium marked thereon, so that the player may then color the field portion of the scoring sheet blue.

The game may be won by the player who is first to color red all of the stripe portions and color blue the field portion on his or her scoring sheet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of playing a game, comprising:

providing a game apparatus including:

a game board having a path for advancing game pieces of players along, the path comprising a plurality of spaces for advancing the game piece of a player as the player moves along the game path, a portion of the spaces each having a sponsor indicium marked thereon that is associated with a sponsoring entity located in a geographical area, a portion of the plurality of spaces of the path being associated with a first trivia category, a portion of the plurality of spaces of the path being associated with a second trivia category, a portion of the plurality of spaces of the path being associated with a third trivia category, and a portion of the plurality of spaces of the path being associated with a fourth trivia category; and a scoring sheet having a plurality of stripe portions and a field portion, the stripe portions and field portion being arranged on the scoring sheet in a configuration appearing as a United States flag;

rolling a die by a player;

moving the player's game piece along the game path a number of spaces corresponding to a value indicated by the die and landing the player's game piece on one of the plurality of spaces;

coloring, by a player, one of the stripe portions of the scoring sheet of the player with the red marking device or coloring the field portion of the scoring sheet of the player with the blue marking device, when a preset condition is satisfied; and winning the game by the player having all of the stripe portions colored red and the field portion colored blue.

2. The method of claim 1 additionally comprising providing a plurality of cards including a set associated with each of the trivia categories, and wherein one of the preset conditions for the coloring step comprises choosing one of the plurality of cards corresponding to the trivia category on which the player's game piece lands, and correctly answering a question from the selected card.

3. The method of claim 1 wherein one of the preset conditions comprises landing the player's game piece on a space and correctly naming a person associated with the sponsoring entity associated with the space on which the player's game piece lands.

4. The method of claim 1 wherein one of the plurality of spaces of the path of the game board has a red crayon indicium marked thereon and one of the plurality of spaces has a blue crayon indicium marked thereon, and wherein one of the preset conditions of the coloring step comprises landing on the space having the red crayon indicium marked thereon to color one of the stripe portions red or landing on the space having the blue crayon indicium marked thereon and coloring the field portion blue.

5. The method of claim 1 wherein the providing step comprises providing a plurality of sets of cards including:

a first set of the plurality of cards being associated with the first trivia category, the first set of cards including a plurality of subsets of cards, a first subset of the first set of cards comprising multiple choice trivia cards, a second subset of the first set of cards comprising sponsor association cards, a third subset of the first set of cards comprising "lose a turn" cards, and a fourth subset of the first set of cards comprising "group favor redemption" cards;

a second set of the plurality of cards being associated with the second trivia category, the second set of cards including a plurality of subsets of cards, a first subset of the second set of cards comprising multiple choice trivia cards, a second subset of the second set of cards comprising sponsor association cards, a third subset of the second set of cards comprising "lose a turn" cards, and a fourth subset of the second set of cards comprising "group favor redemption" cards;

a third set of the plurality of cards being associated with the third trivia category, the third set of cards including a plurality of subsets of cards, a first subset of the third set of cards comprising multiple choice trivia cards, a second subset of the third set of cards comprising sponsor association cards, a third subset of the third set of cards comprising "lose a turn" cards, and a fourth subset of the third set of cards comprising "group favor redemption" cards; and a fourth set of the plurality of cards being associated with the fourth trivia category, the fourth set of cards including a plurality of subsets of cards, a first subset of the fourth set of cards comprising multiple choice trivia cards, a second subset of the fourth set of cards comprising sponsor association cards, a third subset of the fourth set of cards comprising "lose a turn" cards, and a fourth subset of the first set of cards comprising "group favor redemption" cards.

6. The method of claim 1 wherein the plurality of spaces of the path of the game board includes a group of city services spaces, and wherein one of the preset conditions of the coloring step comprises and naming a person associated with the city service of the space on which the player's game piece lands.

7. The method of claim 6 wherein one of the group of city services spaces has "CITY HALL" indicium marked thereon, one of the group of city services spaces has "POLICE DEPT." indicium marked thereon, and one of the group of city services spaces has "FIRE DEPT." indicium marked thereon; and the naming step includes naming the mayor of the hometown when the player's game piece lands on the "CITY HALL" spaces, naming one of the members of the police department when the player's game piece lands on the "POLICE DEPT." space, and naming one of the members of the fire department when the player's game piece lands on the "FIRE DEPT." space.

8. The method of claim 1 wherein at least one of the plurality of spaces on the path on the game board comprises a "GROUP FAVOR" space, and additionally comprising performing a group favor by the player when the player lands on the "GROUP FAVOR" space on the game board unless the player holds a group favor redemption cards.

9. The method of claim 8 wherein the group favor comprises obtaining a snack for each of the other of the players playing the game.

10. The method of claim 8 wherein the group favor comprises obtaining a snack for each of the other of the players playing the game.

11. A game apparatus comprising:

a game board having a path for advancing game pieces of players along, the path comprising a plurality of spaces for advancing the game piece of a player as the player moves along the game path;

wherein a portion of the spaces each has a sponsor indicium marked thereon that is associated with a sponsoring entity located in a geographical area;

wherein at least one of the plurality of spaces comprises a "GROUP FAVOR" space, the at least one group favor space having "GROUP FAVOR" indicium marked thereon, wherein four of the "GROUP FAVOR" spaces are included in said game path;

wherein a portion of the plurality of spaces of the path are associated with a first trivia category, a portion of the plurality of spaces of the path are associated with a second trivia category, a portion of the plurality of spaces of the path are associated with a third trivia category, and a portion of the plurality of spaces of the path are associated with a fourth trivia category;

wherein one of the plurality of spaces has a red crayon indicium marked thereon and one of the plurality of spaces has a blue crayon indicium marked thereon;

a scoring sheet having a plurality of stripe portions and a field portion, the stripe portions and field portion being arranged on the scoring sheet in a configuration appearing as a United States flag; and at least two marking devices, a first one of the at least two marking devices marking in a blue color for marking the field portion of the scoring sheet and a second one of the at least two marking devices marking in a red color for marking the stripe portions of the scoring card.

12. The apparatus of claim 11 wherein the plurality of spaces includes a group of city services spaces, one of the group of city services spaces having "CITY HALL" indicium marked thereon, one of the group of city services spaces having "POLICE DEPT." indicium marked thereon, and one of the group of city services spaces having "FIRE DEPT." indicium marked thereon.

13. The apparatus of claim 11 wherein a perimeter portion of the path is positioned along a portion of a perimeter of the game board and a convoluted portion of the path is positioned substantially within the perimeter portion of the path.

14. The apparatus of claim 11 wherein one of the plurality of spaces comprises a start space.

15. The apparatus of claim 11 wherein at least one of the plurality of spaces has a directional arrow marked thereon.

16. The apparatus of claim 11 wherein the spaces associated with the first trivia category have a first indicium marked thereon, the spaces associated with the second trivia category have a second indicium marked thereon, the spaces associated with the third trivia category having a third indicium marked thereon, the spaces associated with the fourth trivia category having a fourth indicium marked thereon.

17. The apparatus of claim 16 wherein the first trivia category comprises an education theme and the first indicium comprises an apple, the second trivia category comprises a health theme and the second indicium comprises an "H" indicium, the third trivia category comprises a patriotic theme and the third indicium comprises a flag indicium, and the fourth trivia category comprises a religious theme and the fourth indicium comprises a cross indicium.

18. A method of playing a game, comprising:

providing a game apparatus including:

a game board having a path for advancing game pieces of players along, the path comprising a plurality of spaces for advancing the game piece of a player as the player moves along the game path;

wherein one of the plurality of spaces comprises a start space;

wherein at least one of the plurality of spaces comprises a "GROUP FAVOR" space, the at least one group favor space having "GROUP FAVOR" indicium marked thereon;

wherein a portion of the spaces each has a sponsor indicium marked thereon that is associated with a sponsoring entity located in a geographical area;

wherein a portion of the plurality of spaces of the path are associated with a first trivia category, the spaces associated with the first trivia category having a first indicium marked thereon, the first trivia category comprising an education theme, each of the spaces associated with the first trivia category having an apple indicium marked thereon;

wherein a portion of the plurality of spaces of the path are associated with a second trivia category, the spaces associated with the second trivia category having a second indicium marked thereon, the second trivia category comprising a health theme, each of the spaces associated with the second trivia category having an "H" indicium marked thereon;

wherein a portion of the plurality of spaces of the path are associated with a third trivia category, the spaces associated with the third trivia category having a third indicium marked thereon, the third trivia category comprising a patriotic theme, each of the spaces associated with the third trivia category having a flag indicium marked thereon;

wherein a portion of the plurality of spaces of the path are associated with a fourth trivia category, the spaces associated with the fourth trivia category having a fourth indicium marked thereon, the fourth trivia category comprising a religious theme, each of the spaces associated with the fourth trivia category having a cross indicium marked thereon;

wherein one of the plurality of spaces has a red crayon indicium marked thereon and one of the plurality of spaces has a blue crayon indicium marked thereon;

wherein the plurality of spaces includes a group of city services spaces, one of the group of city services spaces having "CITY HALL" indicium marked thereon, one of the group of city services spaces having "POLICE DEPT." indicium marked thereon, one of the group of city services spaces having "FIRE DEPT." indicium marked thereon;

at least two scoring sheets, each of the scoring sheets having a plurality of stripe portions and a field portion, the stripe portions and field portion being arranged on the scoring sheet in a configuration appearing as a United States flag, the stripe portions being separated from each other by at least one blank stripe portion;

a plurality of dice;

a plurality of game pieces;

a plurality of marking devices for marking on the game sheets, the plurality of marking devices including a red marking device and a blue marking device;

a plurality of sets of cards including:

a first set of the plurality of cards being associated with the first trivia category, the first set of cards including a plurality of subsets of cards, a first subset of the first set of cards comprising multiple choice trivia cards, a second subset of the first set of cards comprising sponsor association cards, a third subset of the first set of cards comprising "lose a turn" cards, and a fourth subset of the first set of cards comprising "group favor redemption" cards;

a second set of the plurality of cards being associated with the second trivia category, the second set of cards including a plurality of subsets of cards, a first subset of the second set of cards comprising multiple choice trivia cards, a second subset of the second set of cards comprising sponsor association cards, a third subset of the second set of cards comprising "lose a turn" cards, and a fourth subset of the second set of cards comprising "group favor redemption" cards;

a third set of the plurality of cards being associated with the third trivia category, the third set of cards including a plurality of subsets of cards, a first subset of the third set of cards comprising multiple choice trivia cards, a second subset of the third set of cards comprising sponsor association cards, a third subset of the third set of cards comprising "lose a turn" cards, and a fourth subset of the third set of cards comprising "group favor redemption" cards;

a fourth set of the plurality of cards being associated with the fourth trivia category, the fourth set of cards including a plurality of subsets of cards, a first subset of the fourth set of cards comprising multiple choice trivia cards, a second subset of the fourth set of cards comprising sponsor association cards, a third subset of the fourth set of cards comprising "lose a turn" cards, and a fourth subset of the first set of cards comprising "group favor redemption" cards;

rolling the dice by a player;

moving the player's game piece along the game path a number of spaces corresponding to a value indicated by the dice;

landing the player's game piece on one of the plurality of spaces;

selecting one of the plurality of cards from the set of cards of the trivia category corresponding to the indicium marked on the space on which the player's game piece landed;

losing a turn of the player when the players draw one of the "lose a turn" cards;

performing a group favor by the player when the player lands on the "GROUP FAVOR" space on the game board unless the player holds one of the group favor redemption cards, wherein the group favor comprises obtaining a snack for each of the other of the players playing the game;

coloring, by a player, one of the stripe portions of the scoring sheet of the player with the red marking device or coloring the field portion of the scoring sheet of the player with the blue marking device, when:

landing the player's game piece on a space and correctly answering the question from one of the sets of cards; or landing the player's game piece on a space and correctly naming 108 a person associated with the sponsoring entity associated with the 109 sponsor indicium of the space on which the game piece ha landed; or landing on one of the city services spaces marked "CITY HALL" and naming the mayor of the hometown; or landing on one of the city services spaces marked "POLICE DEPT" and naming one of the members of the police department of the hometown; or landing on one of the city services spaces marked "FIRE DEPT" and naming one of the members of the fire department of the hometown; or landing on the space having the red crayon indicium marked thereon and coloring one of the stripes red; or landing on the space having the blue crayon indicium marked thereon and coloring the field blue; and winning the game by the player having all of the stripe portions colored red and the field portion colored blue.

19. A method of playing a game, comprising:

providing a game apparatus including:

a game board having a path for advancing game pieces of players along, the path comprising a plurality of spaces for advancing the game piece of a player as the player moves along the game path, a portion of the spaces each having a sponsor indicium marked thereon that is associated with a sponsoring entity located in a geographical area, a portion of the plurality of spaces of the path being associated with a first trivia category, a portion of the plurality of spaces of the path being associated with a second trivia category, a portion of the plurality of spaces of the path being associated with a third trivia category, and a portion of the plurality of spaces of the path being associated with a fourth trivia category, wherein at least one of the plurality of spaces on the path on the game board comprises a "GROUP FAVOR" space; and a scoring sheet having a plurality of stripe portions and a field portion, the stripe portions and field portion being arranged on the scoring sheet in a configuration appearing as a United States flag;

rolling a die by a player;

moving the player's game piece along the game path a number of spaces corresponding to a value indicated by the die and landing the player's game piece on one of the plurality of spaces;

coloring, by a player, one of the stripe portions of the scoring sheet of the player with the red marking device or coloring the field portion of the scoring sheet of the player with the blue marking device, when a preset condition is satisfied;

performing a group favor by the player when the player lands on the "GROUP FAVOR" space on the game board unless the player holds a group favor redemption cards; and winning the game by the player having all of the stripe portions colored red and the field portion colored blue.

* * * * *